United States Patent [19]

Chervanak

[11] 4,140,356

[45] Feb. 20, 1977

[54] STORAGE UNIT

[75] Inventor: Robert A. Chervanak, Seattle, Wash.

[73] Assignee: Comerco, Inc., Tacoma, Wash.

[21] Appl. No.: 791,323

[22] Filed: Apr. 27, 1977

[51] Int. Cl.[2] ..... A47B 51/00

[52] U.S. Cl. ..... 312/350; 312/111; 312/270; 312/348

[58] Field of Search ..... 312/107, 108, 111, 249, 312/250, 348, 350, 270

[56] References Cited

U.S. PATENT DOCUMENTS

| | | | |
|---|---|---|---|
| 3,212,646 | 8/1965 | Probst | 52/36 |
| 3,241,898 | 3/1966 | Probst | 312/348 |
| 3,712,697 | 1/1973 | Kricky et al. | 312/297 |
| 3,712,698 | 1/1973 | Probst et al. | 312/350 |
| 3,716,282 | 2/1973 | Probst et al. | 312/350 |
| 3,752,547 | 8/1973 | Probst et al. | 312/107 |
| 3,826,550 | 7/1974 | Probst et al. | 312/107 |

*Primary Examiner*—Casmir A. Hunberg
*Attorney, Agent, or Firm*—Gipple & Hale

[57] ABSTRACT

A storage unit is comprised of two side walls, a rear wall, top and bottom wall and a front opening. The interior of the storage unit defines a storage cavity which is adapted to receive sliding drawers, trays or shelves. The interior of the side wall of the storage cavity defines a plurality of integrally molded support and stability arms. The drawers, trays or shelves slide between pairs of arms and are prevented from unintentional withdrawal by abutment stops. A trackway is provided in the interior which allows a tarbour door to close off the frontal opening and a drop front door is also disclosed to seal off the unit from outside contamination. Base units and transportation apparatus are also provided as attachments to the unit.

26 Claims, 38 Drawing Figures

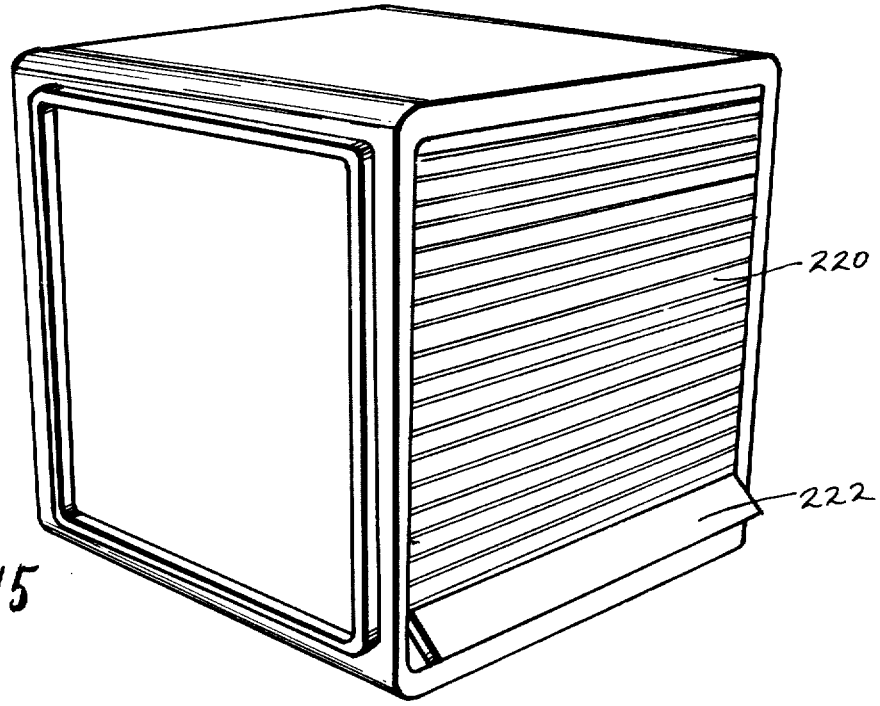
Fig. 15
Fig. 16
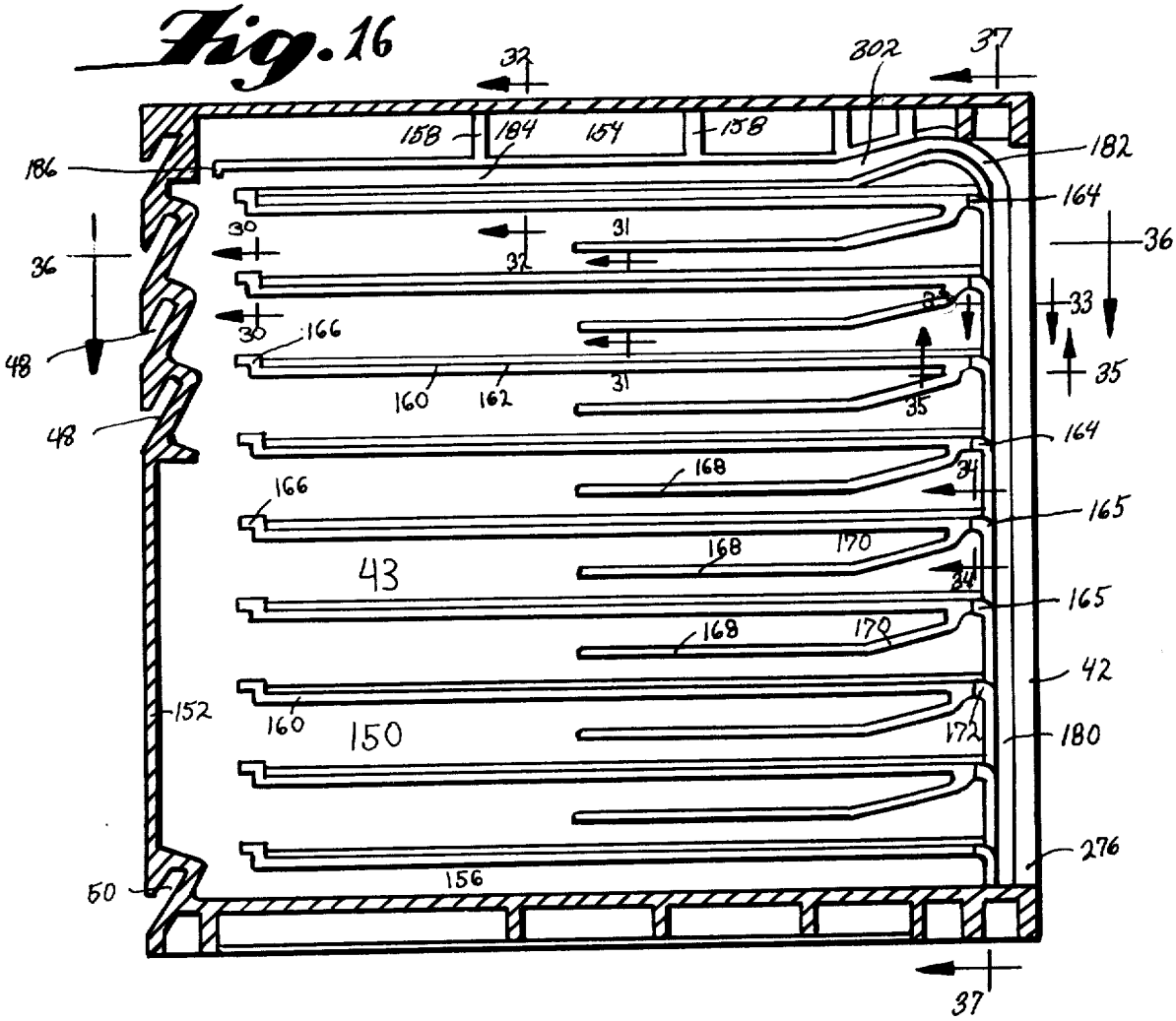

Fig. 17
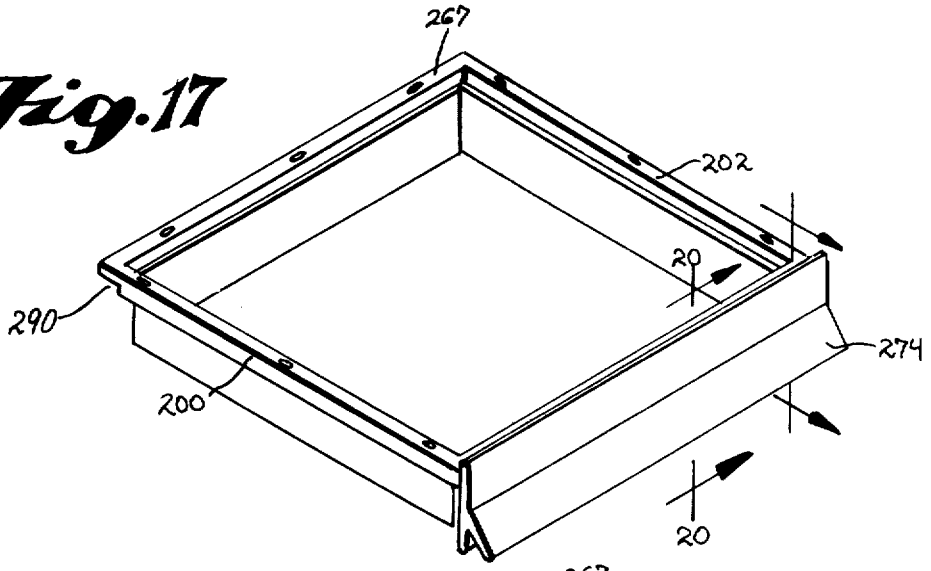
Fig. 18
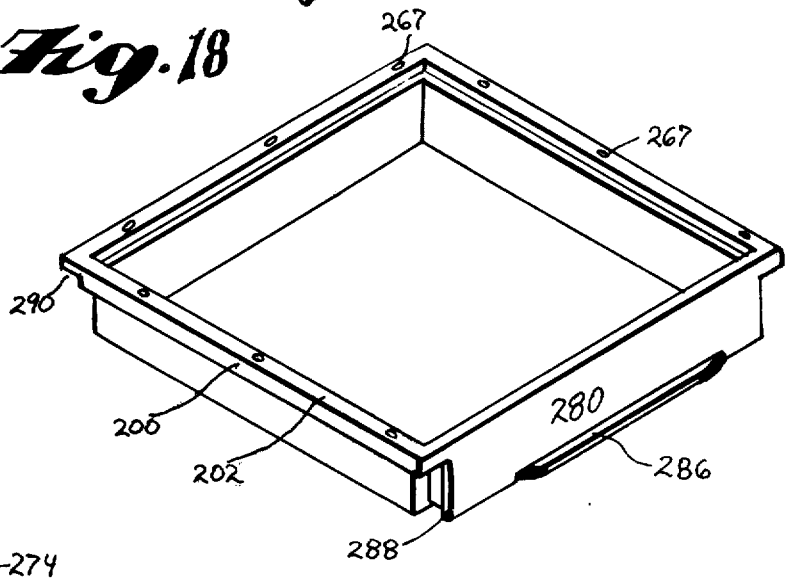
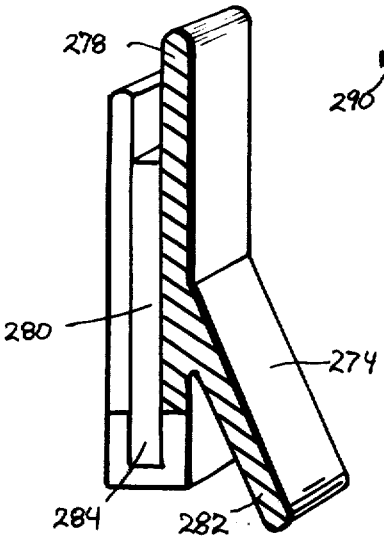
Fig. 19
Fig. 20
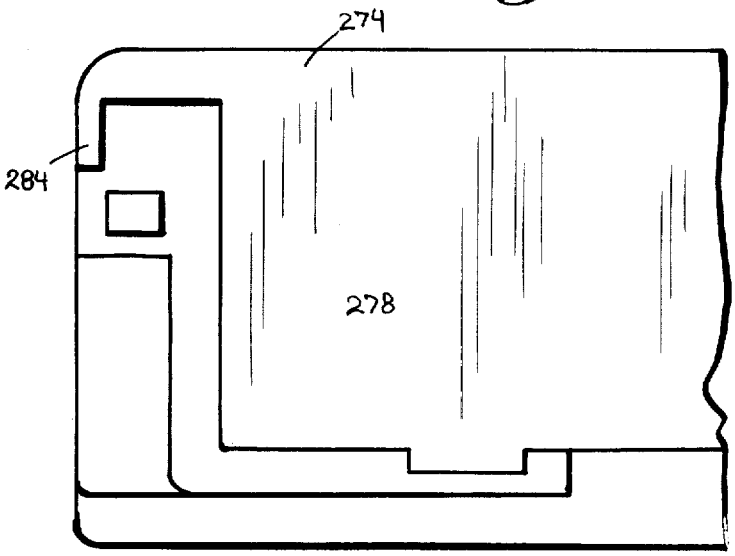

Fig. 21
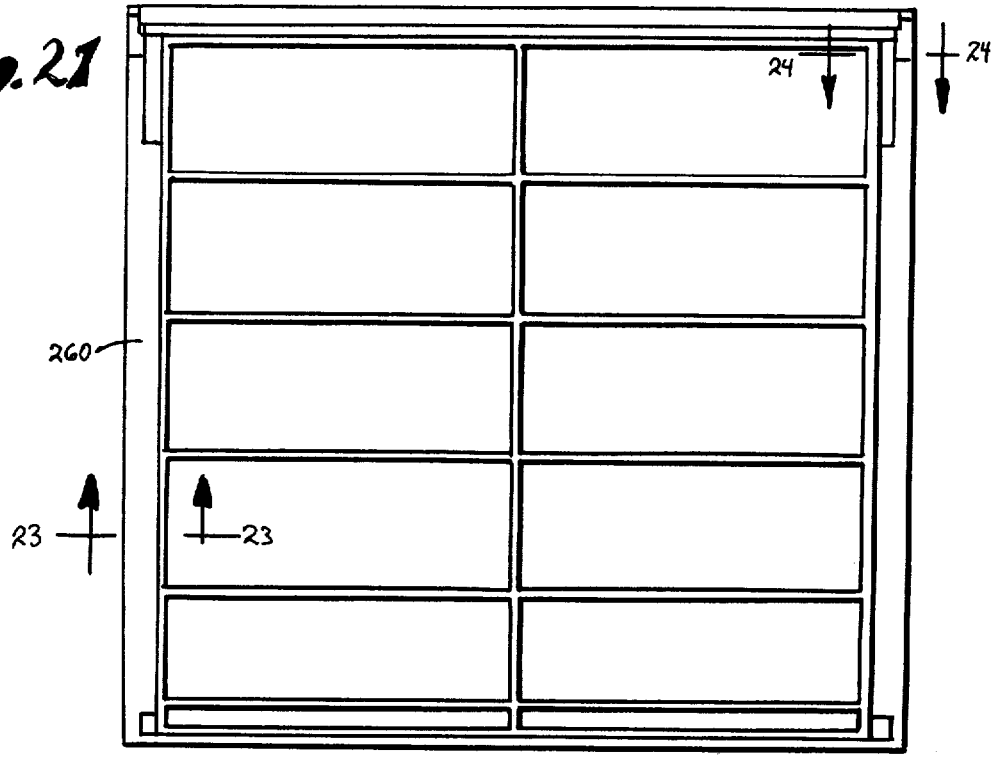
Fig. 22
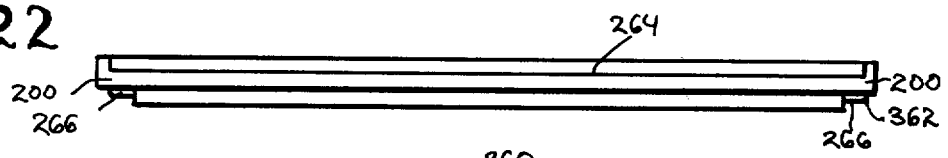
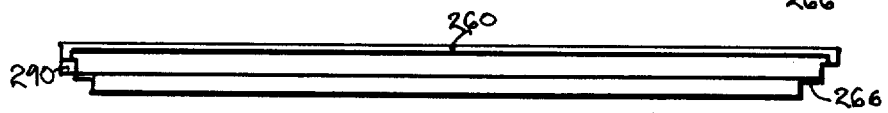
Fig. 22a
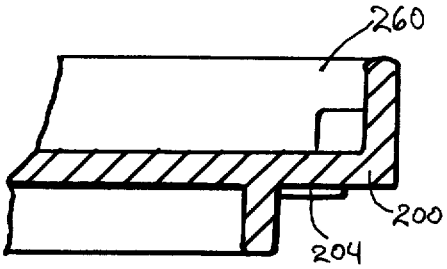
Fig. 23
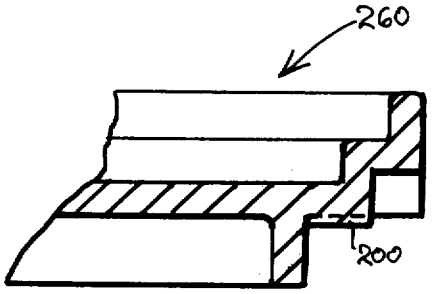
Fig. 24

STORAGE UNIT

BACKGROUND OF THE INVENTION

This invention generally relates to the field of unitary modular cell units which are useful in organizing and storing smaller items. The modular cell units serve in the same capacity as a storage cabinet. More specifically, the modular cell can be employed in a hospital setting for the storage of a patient's personal belongings, clothing or medicines.

The modern hospital faces unique and frustrating problems. Hospitals provide a multitude of services, each demanding improvement and each threatened by rising costs and obsolescence. Many independent products and subsystems are frequently in wasteful conflict with each other. In order to provide good service, the hospital must have coherent performance. Although hospital sanitary procedures and controls have improved, they are finally reduced to a practice of overcompensation to balance the unsanitizable character of many hospital equipment structures. This group of "unsanitizable" structures would include most furniture, professional equipment, transporting devices, containers and storage units of a size larger than a bread box. All surfaces, without exception, should and need to be clearly accessible for removal of contaminated material and for sterilization. THere should be no seams, no cracks, no interior grooves, no hinges and no unsealed shell interiors penetrable by air or liquid flow in order to preserve a sanitary atmosphere. With rare exception, present structures do not lend themselves to disassembly for proper cleaning.

In operating a hospital, it has increasingly become apparent that the visible physical characteristics of the patient's room or surroundings can indeed have a profound impact on the psychological outlook of the patient. It is also well established that a happy patient generally feels physically better than an unhappy one. These rather obvious conclusions dictate a style for a designer of hospital equipment and furniture. In order to be aesthetically pleasing to the patient and yet maintain extreme functionality, a system of unitary modular cell units is constructed. Each individual cell unit is capable of storing a plurality of items of various shapes and sizes in an extremely aesthetically pleasing manner. Each cell unit is constructed of a hard, resilient and durable plastic which allows the units to be molded as one solid piece thereby eliminating any unsightly seams. The elimination of seams tends to substantially decrease the degree of impurities maintained in a structure after sterilization. The elimination of seams also tends to increae the cell unit's structural rigidity.

A plurality of cell units can be used in a patient's room. The units are secured to the walls of the room by being attached to a wall rail which rail is fastened to the room wall at an appropriate height. The modular cell unit is secured to the wall by means of a mounting key which fits and is held by both the unit's rear surface and the wall rail. As the units are readily detachable from the walls they can be sterilized each and every time a new patient occupies a particular room. This obviously leads to a more sanitary hospital environment in addition to preventing the transfer of disease or germs from patient to room articles to new patient.

Additionally, the modular cell units are provided with drawers, pull trays or shelves which slide in and out of the front of the cell unit. The storage drawers, shelves or pull trays can be "mixed & matched" to provide a variety of cell unit configurations. Quite obviously the flexibility of the unit to take on a plethora of functional embodiments is a tremendous advantage to the hospital. The cell drawers, shelves or pull trays are also constructed of heavy duty plastic and therefore can be sterilized after removal.

A variety of front doors can be selectively secured to the modular cell unit. Specifically, the cell can be provided with a side-hinged front door, a drop-front door, or a roll-top front door. The modular cell unit is also provided with a vertical and horizontal trackway which guides the drop-front door and the roll-top door. Both of these doors are stored in the modular cell when placed in their inoperative position.

The present system of containers, frames, trays, drawers, carts and wall rails coordinate the architectural and service functions of the hospital. The following individual features of the present system contribute to the systems validity.

Improved sanitary procedures require a system to be dishwashable. As mentioned, the present system is made of tough resilient plastic and therefore able to withstand vigorous industrial dishwashing. The present modular cell unit is without seams, nor sharp corners and also is provided with drainage holes to allow for water to easily drain. Additionally, the surfaces of the unit are readily assessible to dishwashing jets. As all parts readily disassemble, they may be sanitized by use of a conventional industrial dishwasher.

The use of the cell system in modular form allows the hospital to selectively replace those items whose function and/or appearance have failed. In this manner, the hospital can eliminate the "gray life" failure in structures.

DESCRIPTION OF THE PRIOR ART

U.S. Pat. No. 3,212,646 discloses a support system for detachably supporting a modular cell unit to a generally plane vertical surface, i.e., a wall. A longitudinal rail is formed or secured to the rear of the furniture piece. A correspondingly mating wall rail, secured to the wall of a room, is "hooked" onto by the furniture rail. In this manner, furniture is secured to various parts of a room.

U.S. Pat. No. 3,241,898 discloses a C-shaped storage unit for hospitals. The C-shaped frame includes a back and a pair of parallel legs extending therefrom. The frame of the storage unit is provided with stops at a position proximate to the free end of each of the parallel legs.

U.S. Pat. No. 3,712,697 teaches a storage locker whose side walls provide means for slidably receiving a vertically sliding door, means on said side walls for removing the vertically sliding door and hinge means for selectively providing a hinged front.

U.S. Pat. No. 3,712,698 is directed toward a system for removeably supporting drawers or shelves so that their positions can be both horizontally and vertically varied.

U.S. Pat. No. 3,716,282 discloses a supporting member for drawers which comprise a plastic frame with drawer guides being integrally molded with its sides. A front door for the frame comprises a face panel with brackets projecting from the rear and at either side of the face panel.

U.S. Pat. No. 3,752,547 discloses and claims a rectangular drawer with a guide flange extending from the rear and side walls for sliding and supporting the drawer.

Finally, U.S. Pat. No. 3,826,550 discloses a drawer and drawer supporting combination. The drawers are provided with glide flanges which glide over the guide flanges located along the interior walls of the drawer support cabinet.

SUMMARY OF THE INVENTION

The present system comprises a modular cell unit with one open face. The open face provides an entrance and cavity for the selective withdrawal and storage of trays or drawers located and held within the unit. The entire modular cell is readily secured to a wall in a hospital room by means of a wall rail and mounting key. The rear surface of the modular cell unit is provided with a plurality of horizontally extending slots into which a "mounting key" is selectively inserted for adjusting the relative height of the unit with respect to the floor of the room. The other end of the "mounting key" is fixedly held in a groove provided by the wall rail. At the bottom of the rear surface of the modular cell is another horizontally extending slot which provides an opening for a leveling key. This key is inserted therein andprovides a rear planar surface which abuts against the vertical wall of the room and thereby keeps the entire modular cell in a horizontal level condition.

The two sides of the modular cell are provided with spacing ridges which allow the cells to be placed adjacent each other in an orderly fashion. These ridges abut the ridges of the adjoining cell and close off any space between the side walls of the adjacent units so that any item that may accidentally fall between these units will be prevented from either hitting the floor or being lodged between the modular cell units.

The interior cavity of the cell units are provided with guiding rails which serve to allow trays, shelves or drawers to slide in and out of the unit. The rails are uniquely constructed to allow the drawers, shelves or trays to be withdrawn to a significant extent yet, however, do not allow the inadvertent total withdrawal of the trays or drawers. In order to completely remove the trays or drawers, it is necessary for the operator to raise up the forward most part of the tray or drawer in order to allow the tray or drawer rear "stops" to avoid the guide rail abutment stop elements. Additionally, the unitary modular cell is provided with a vertically and horizontally extending trackway which allows a sliding cover to be placed over the front end of the unit. This sliding cover is efficiently stored in the top most portion of the interior of the cell. The storage of the cover occurs when its side guide elements slide up the vertical trackway into the connecting horizontal trackway at the top interior of the unitary modular cell. Alternatively, a tambour door is provided to guide in the trackways in a manner similar to a conventional roll top desk.

The drawers or pull trays of the cell system are provided with drainage holes at selective points so that these elements can be placed within an industrial dishwasher to sanitize them while allowing the water to effectively drain off. Additionally, the pull trays are selectively provided with front handles which engage with and secure to the front of the pull trays to facilitate the withdrawal of fhe now-formed drawers from the modular cell unit. These front handles are readily disengaged from the trays and therefore are also easy to sanitize.

The modular cell units are transported by blocks with attached wheels, a unitary base with shelves or hand trucks specifically designed for the system. When it is desired to remove a unit from a wall rail, the operator merely locates the base of the hand truck beneath the cell unit and depresses a foot pedal which raises the modular cell unit and disengages the rear wall key from its mated slot in the wall rail. Subsequently, the modular cells can be moved to another position by the hand truck and similarly mounted and secured to the second wall rail by means of the foot pedal.

Alternatively, the modular cell units are provided with caster wheels which are attached to rectangular blocks which matingly engage and are secured within the undermost surface of the modular cell.

As previously mentioned, it is desirable in a hospital environment to have total components easily sanitized. The sanitation process however provides a significant degree of wear and tear deterioration upon most ordinary hospital items. The modular cell unit, however, is constructed of a very heavy strength plastic which can withstand the rigors and high temperatures of the sanitation process. Additionally, the unit has no seams or sharp corners, which diminishes the deteriorating effect of trapped or caught water in such areas as often occurs in conventional structures.

Additional, the wall rail of the system is provided with a hidden electrical trackway which travels the entire length of the wall rail. The electrical trackway allows electrical wires to run around a hospital room without unsightly wires being visible.

The above mentioned purposes are more readily apparent when read in conjunction with the following detailed description of the preferred embodiment of the present invention.

BRIEF DESCRIPTION OF THE DRAWINGS

FIG. 15 is a perspective view of the modular cell unit with a tambour door;

FIG. 16 is a cross sectional view showing the interior of the modular cell;

FIG. 17 is a perspective view of a drawer;

FIG. 18 is a perspective view of a pull tray;

FIG. 19 is an enlarged rear elevational view of one side of the handle, with the opposite being a mirror image;

FIG. 20 is a cross sectional view taken along lines 20—20 of FIG. 17;

FIG. 21 is a bottom view of a tray;

FIG. 22 is a front elevational view of the tray shown in FIG. 21;

FIG. 22*a* is a rear elevational view of a tray shown in FIG. 21;

FIG. 23 is an enlarged fragmentary cross sectional view taken along lines 23—23 of FIG. 21;

FIG. 24 is an enlarged fragmentary cross sectional view taken along lines 24—24 of FIG. 21;

DETAILED DESCRIPTION OF THE DRAWINGS

Figure 1:
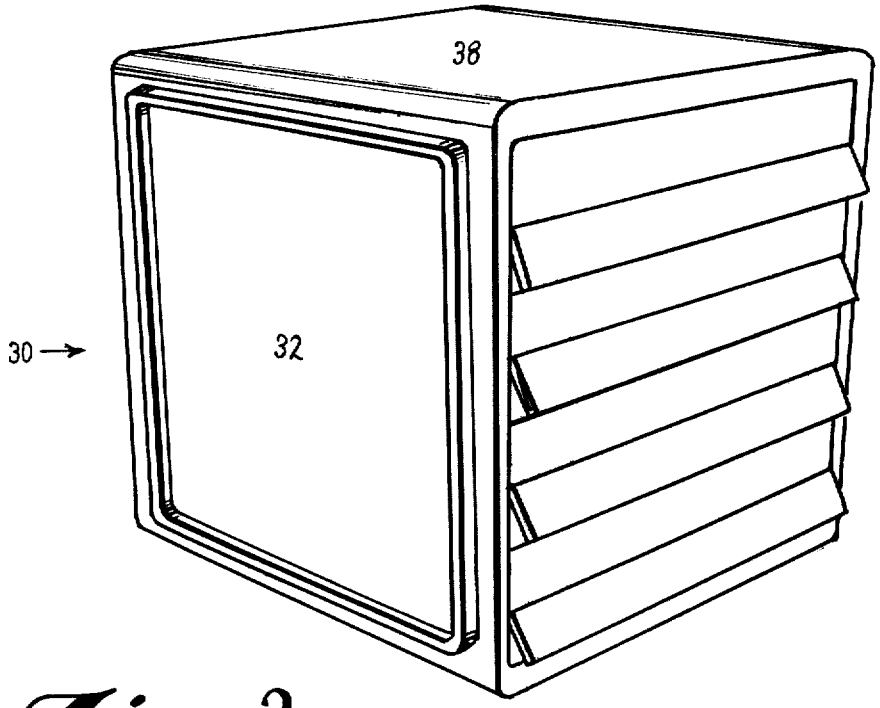
FIG. 1 is a perspective view of a modular cell unit with drawers mounted within the cell's cavity.
Figure 2:
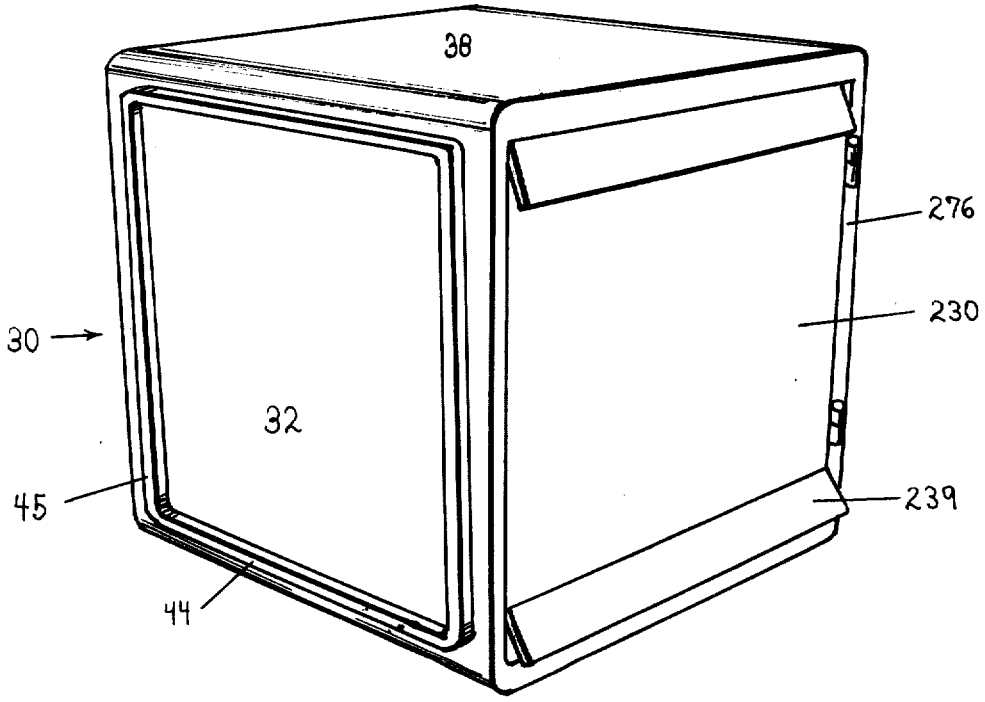
FIG. 2 is a perspective view of the same modular cell unit with the drawers replaced by a hinged front.
Figure 3:
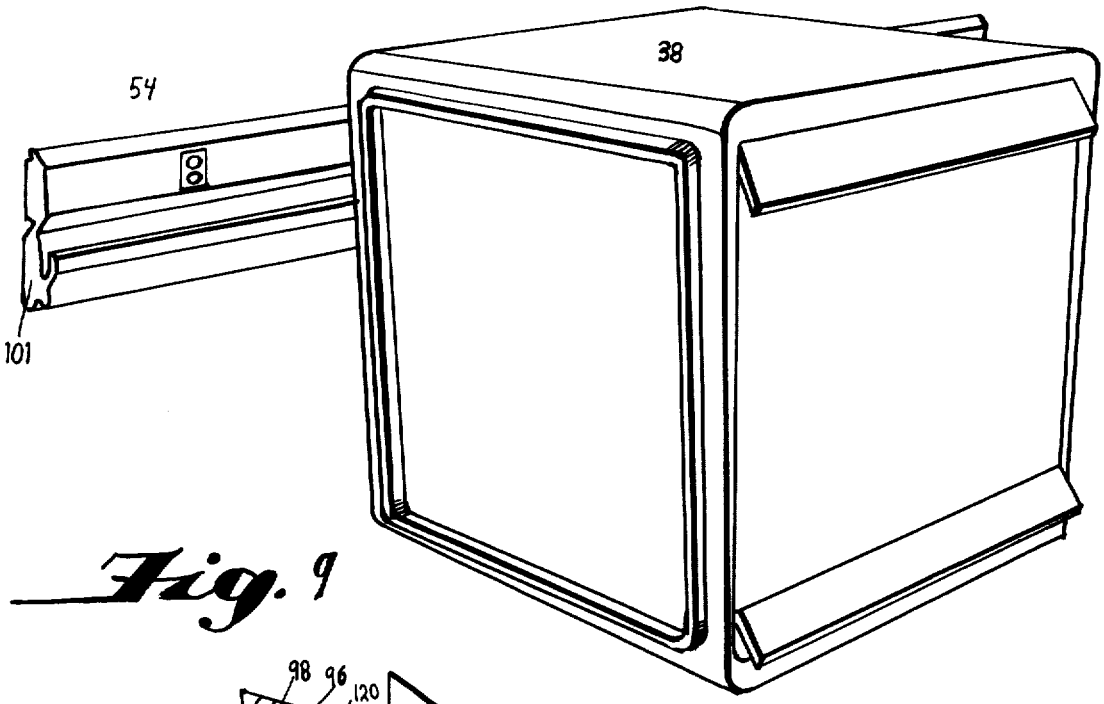
FIG. 3 is a perspective view of a modular cell unit shown attached to a wall rail.

The modular cell unit 30 comprises two outside walls 32 and 34, rear wall 36, top surface 38 and bottom 40. A front opening 42 is provided for facilitating the selective removal and placement of drawers or trays within the cavity 43 of the modular cell unit 30. The entire modular cell unit and its complementary components are constructed of a relatively strong, heat-resistant plastic material. The modular cell unit is constructed without any sharp corners or seams between adjacent wall surfaces. The absence of any seams prolongs the unit's life span, and also prevents any water from being trapped within the unit for any appreciable length of time. Additionally, the absence of sharp corners on the cell provides an aesthetic effect as well as an added safety feature.

Outside wall abutment surfaces or spacing ridges 44 and 46 extend outwardly from outside planar surface of side walls 32 and 34 respectively. Additionally, the outside wall abutment surfaces are recessed inwardly from the outside perimeter of the side walls. The ridges are parallel to the outside perimeter of the side walls, yet recessed inwardly as previously mentioned. When two modular cell units are placed immediately adjacent to each other, the outside wall abutment surfaces will contact each other at their planar contact surfaces 45. Consequently, the two modular cells will be spaced apart a uniform distance. The outside wall abutment surfaces or spacing ridges 44,46 add structural rigidity to the two adjacent units. Additionally, the abutment of the adjacent outside wall abutment surfaces prevents the accidental lodging of any foreign objects between the units and also prevents any objects from falling off the top surface of the unit to the floor. The uniform spacing provided between adjacent modular cell units provides an aesthetically pleasing appearance, which is especially important in hospital environments.

In an alternate embodiment, the ridges of the side walls can be formed so as to interlock with the ridges of adjacent modular cell units.

Figure 8:
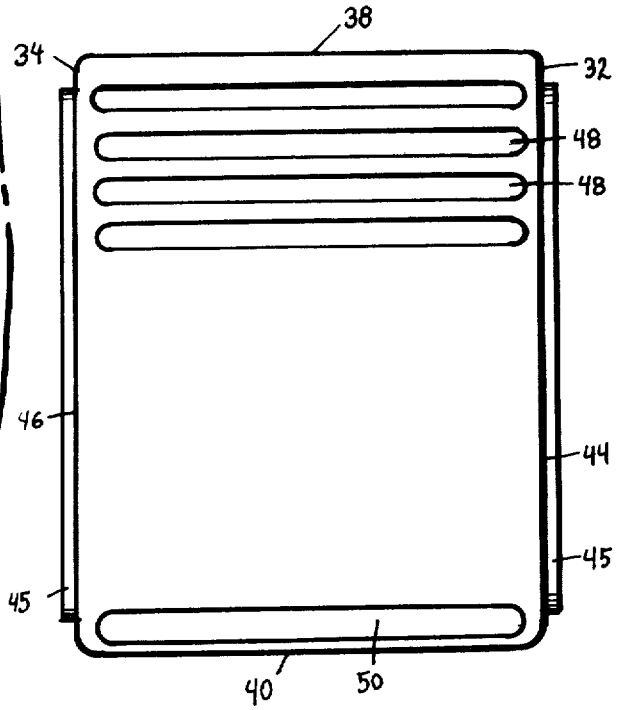
FIG. 8 is a rear elevational view of the modular cell unit.
Figure 4:
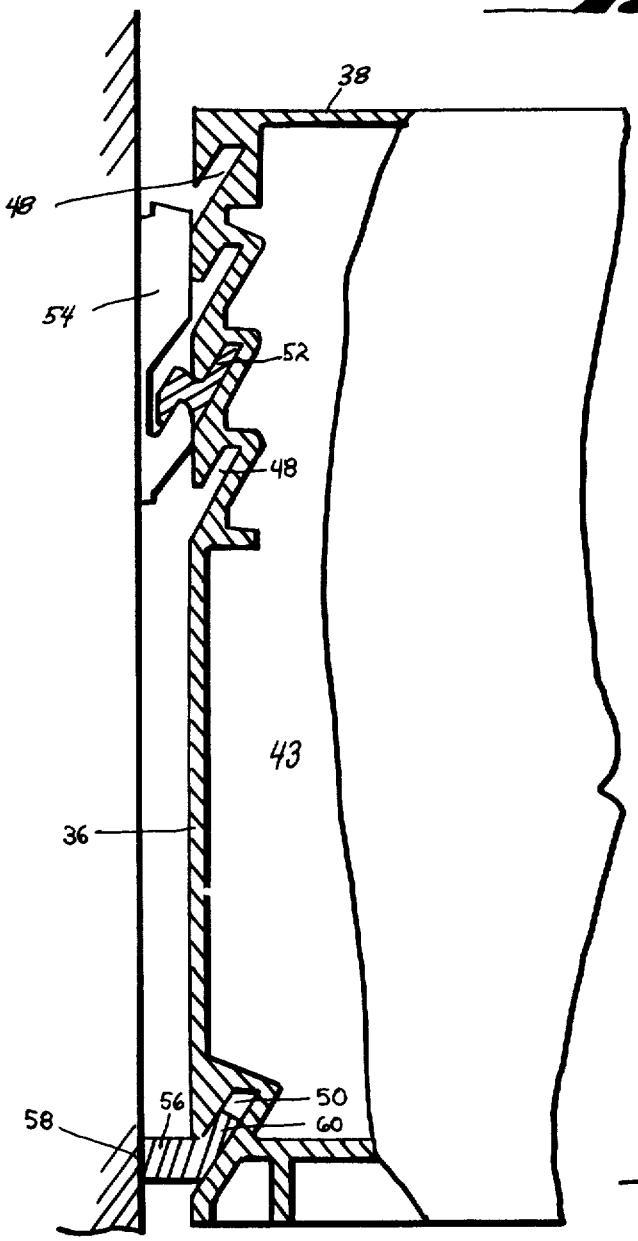
FIG. 4 is an enlarged cross sectional view of the wall rail, mounting key, leveling key and modular cell unit.
Figure 11:
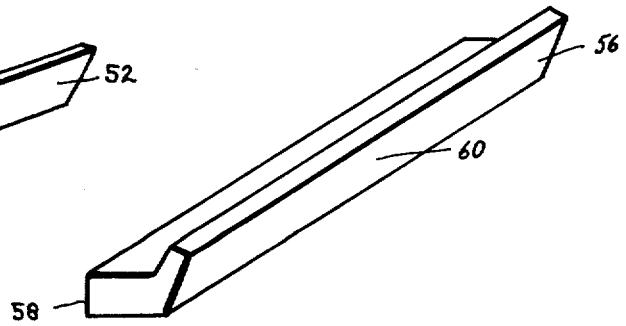
FIG. 11 is a perspective view of the leveling key.
Figure 10:
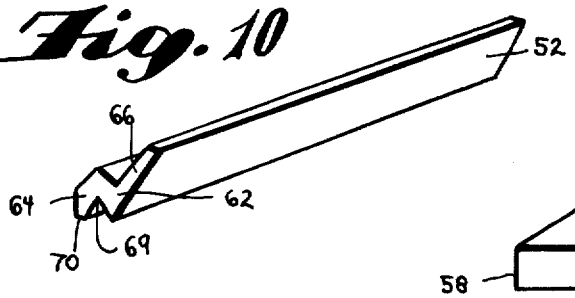
FIG. 10 is a perspective view of the mounting key.
Figure 5:
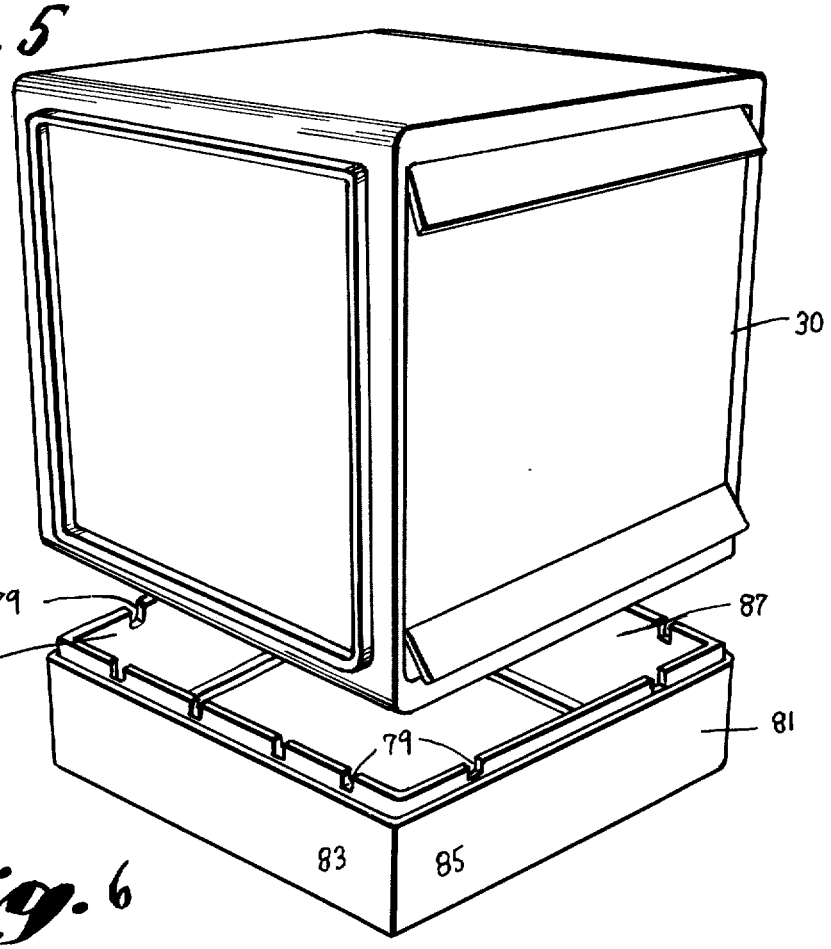
FIG. 5 is an exploded perspective view of a modular cell unit and base.
Figure 6:
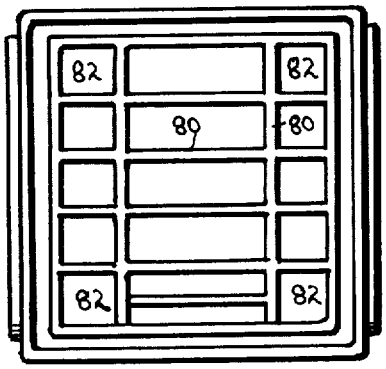
FIG. 6 is a bottom plan view of the modular cell unit.
Figure 7:
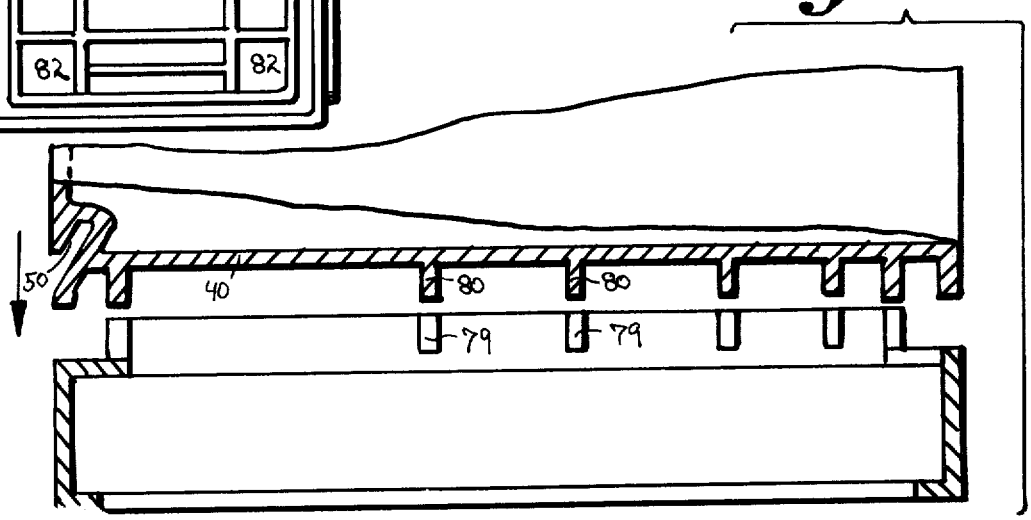
FIG. 7 is a partial cross sectional view partially in section of the modular cell unit before the base is attached thereto.

As best seen in FIGS. 4 and 8, the rear wall 36 is provided with a plurality of upper horizontally extending slots 48. The slots extend angularly upward into the rear of the cavity 43 of the modular cell unit. A mounting key 52, as will be subsequently described, is inserted into the desired upper longitudinal slot 48 in order to adjust the height of the modular cell unit with respect to the wall rail. One leg of the mounting key 52 is secured into the selected horizontal slot 48 while the other leg of the mounting key is held in place by the wall rail 54. The legs of mounting key 52 matingly engage with a slot 48 and slot 53 of wall rail 54. In this manner, the relative height of the modular cell unit can be adjusted without the need of requiring a multitude of unsightly wall rails.

A lower leveling slot 50 is also provided in the rear wall 36 of the modular cell unit 30. The lower leveling slot is horizontally located at the lower portion of the rear wall. This lower level slot 50 matingly receives a leg of the leveling key 56 in the manner previously described. The other leg of the leveling key 56 is provided with a flat surface 58 and is constructed to rest flush against the wall of the room. The modular cell unit can be vertically adjusted by selecting the desired horizontal slot within which the mounting key 52 is to be placed, while the leveling key 56 is always placed in the lower leveling slot 50 in order to space the lower edge of the rear wall 36 of the modular cell from the wall of the room. The leveling key 56 serves the important function of keeping the top surface 38 of the modular cell unit 30 in a level orientation with respect to the floor of the hospital room.

The leveling key 56 comprises a leg 57 with a wall contact surface 58 and a vertically inclined slot-engaging leg 60. In operation, the slot-engaging leg 60 slides upwardly into the lower leveling slot 50. The leveling key and corresponding slot are constructed so that the key will remain with the unit unless the key is intentionally physically removed from the leveling slot. The fact that the key remains with the unit facilitates any change of position of the cell.

Figure 9:
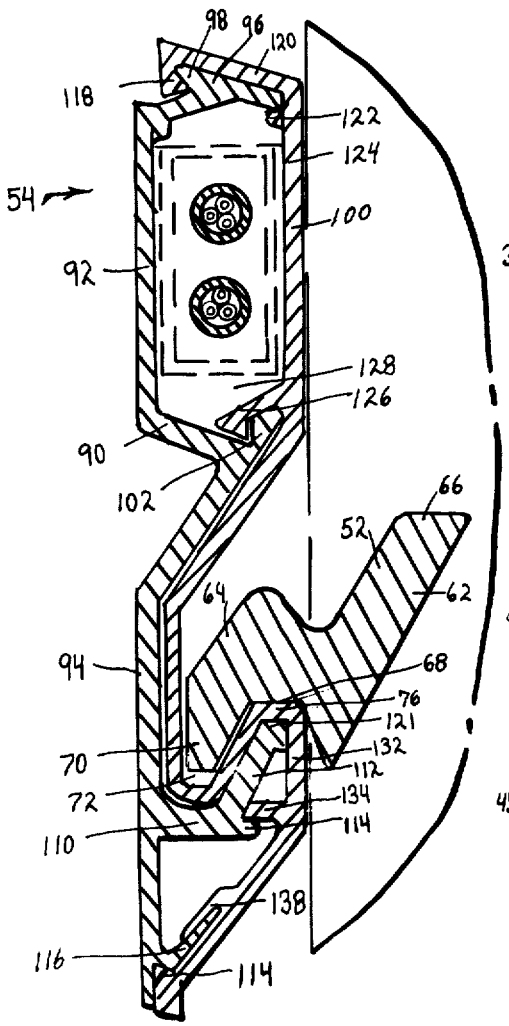
FIG. 9 is an enlarged cross sectional view of the wall rail and key.

The mounting key 52 as best shown in FIG. 9, is comprised of two legs 62 and 64. Leg 62 slides upwardly into the selected longitudinal slot 48. The leg 62 and all slots are constructed so that after the key is placed in an appropriate slot it is there held until actual physical removal takes place. This facilitates the movement of the entire modular cell from one position on the wall rail to another wall rail located elsewhere. The width across the lower portion of leg 62, at the point where the leg 62 turns into leg 64, is a greater width than the width across the tip 66 of the leg. The tip 66 is the first part of the wall rail to enter into the slots 48. Due to the increased width across the leg, the mounting key 52 is frictionally held in place by the top longitudinal slot's side walls. Leg 64 engages the channel formed within the wall rail. Leg 64 is comprised of a surface 68 which engages the wall rail. The tip 70 of the leg 64 is the first section to enter into the channel 72. The ledge engaging surface 68 of leg 64 sits upon ledge 76 of the wall rail. When the mounting key 52 is placed in the selected longitudinal slot 48 and the leg 64 is placed within the channel 72 of the wall rail 54 the entire unit is suspended and securely held by the wall rail. The cantilever action of the modular cell is held in abatement by the leveling key 56. The weight of the modular cell unit is supported by the ledge 76 of the wall rail 54.

As previously mentioned, the mounting key and the leveling key will remain attached to the rear of the modular cell unit unless they are physically intentionally removed. If the modular cell unit is not mounted on the wall but rather stored on the floor or on one of its associated bases then both the mounting key and rail key should be removed. The removal of the two keys facilitates storage of the units as the rear of the modular cell may now be placed flush against a wall. It is apparent that this is not possible where the mounting key and/or leveling key are fixedly attached to the modular cell.

Figure 12:
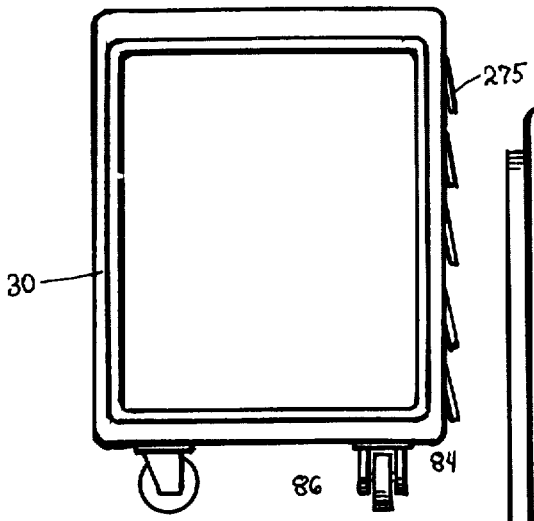
FIG. 12 is a side elevational view of the modular cell unit with caster wheels in place.
Figure 13:
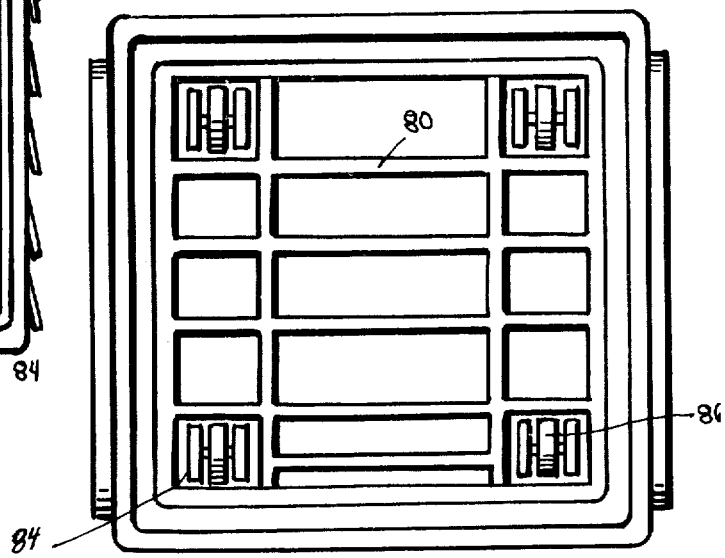
FIG. 13 is a bottom plan view of the modular cell unit with caster wheels in place.
Figure 14:
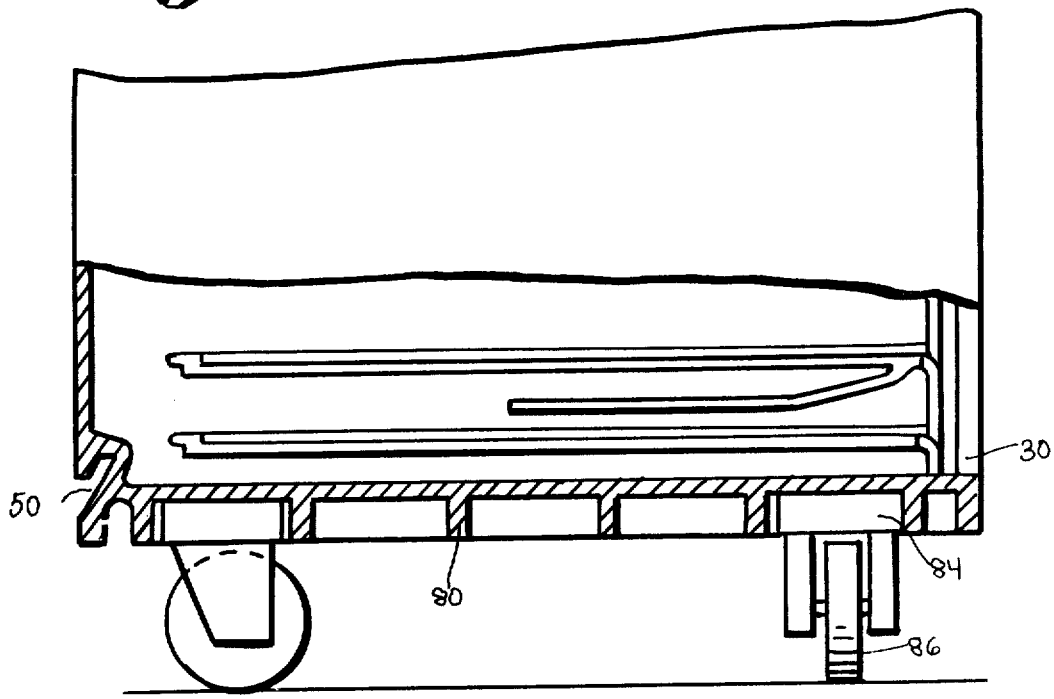
FIG. 14 is a fragmentary enlarged cross sectional view of the modular cell unit with caster wheel in place.
Figure 25:
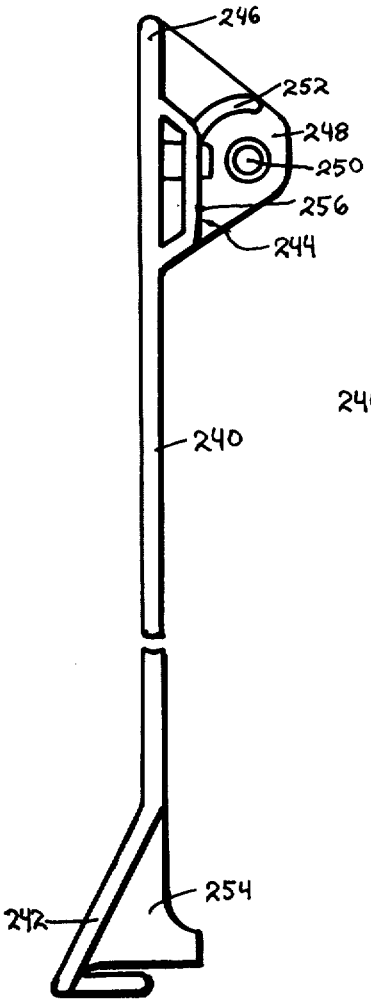
FIG. 25 is a cross sectional view of the drop-front cover of FIG. 26.
Figure 26:
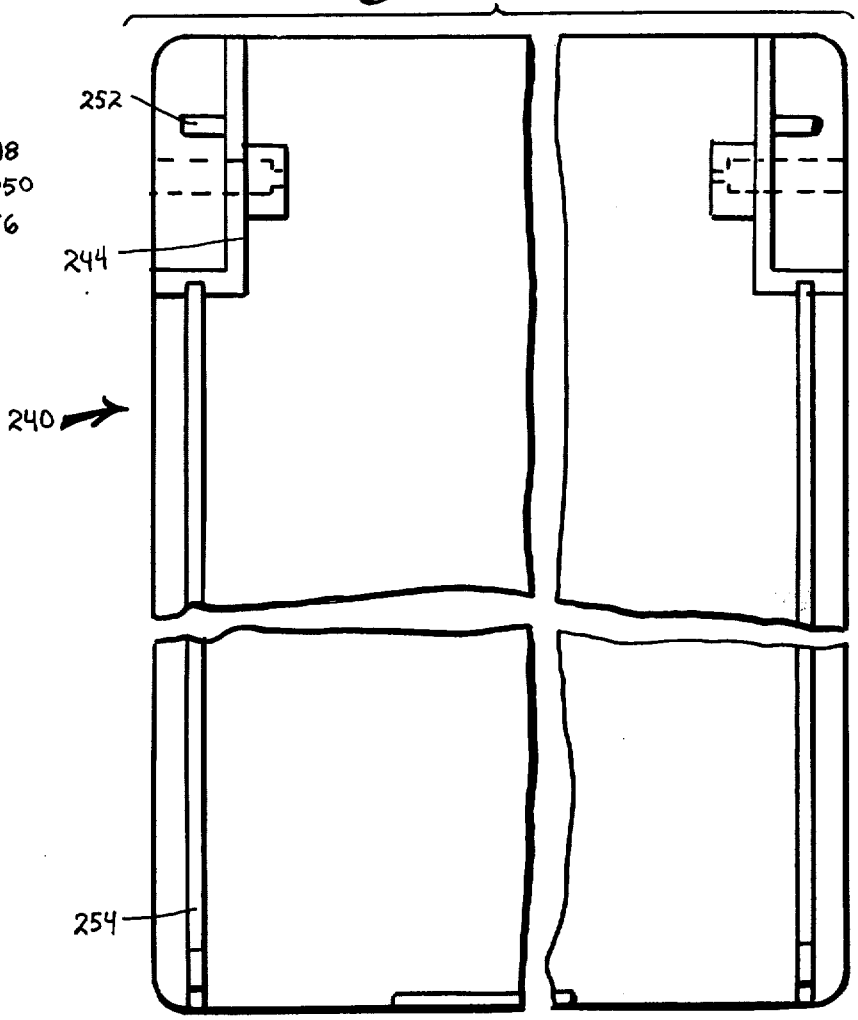
FIG. 26 is a rear elevational view of the drop-front cover.
Figure 30:
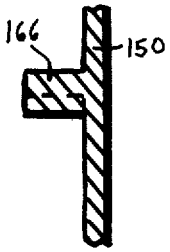
FIG. 30 is a cross-sectional view taken along lines 30—30 of FIG. 16.
Figure 31:
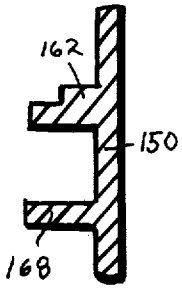
FIG. 31 is a cross sectional view taken along lines 31—31 of FIG. 16.
Figure 32:
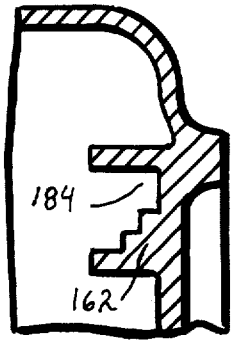
FIG. 32 is an enlarged cross sectional view partially in section taken along lines 32—32 of FIG. 16.
Figure 27:
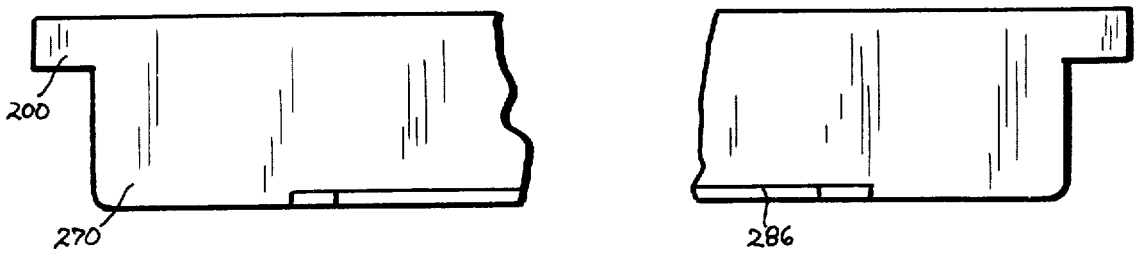
FIG. 27 is a front elevational view of the pull tray.
Figure 28:
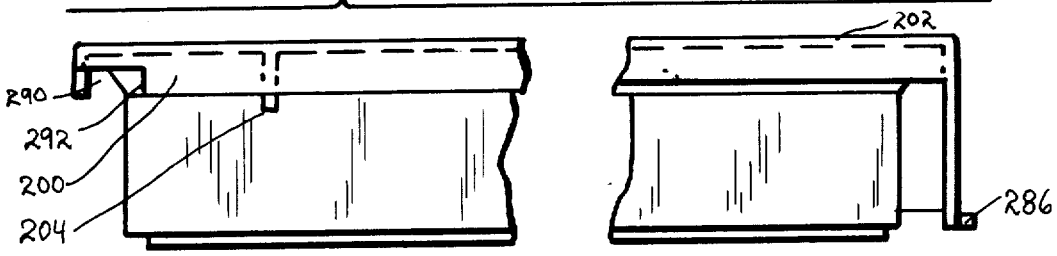
FIG. 28 is a side elevational view of the pull tray.
Figure 29:
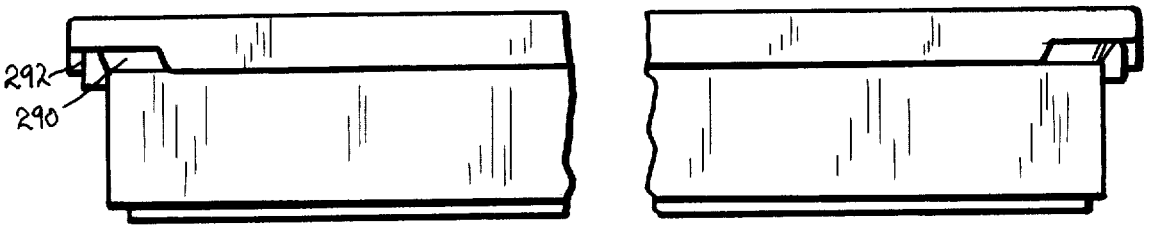
FIG. 29 is a rear elevational view of the pull tray.
Figure 33:
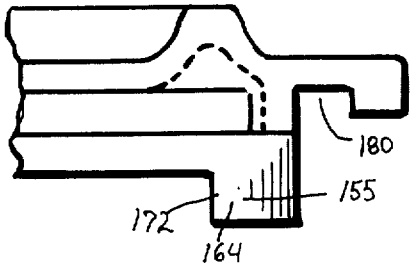
FIG. 33 is an enlarged partial cross sectional view taken along lines 33—33 of FIG. 16.
Figure 35:
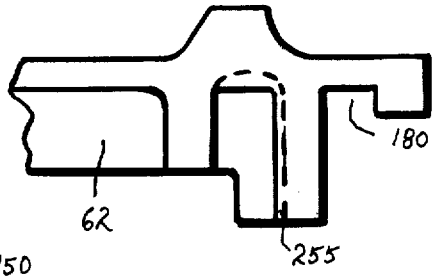
FIG. 35 is a cross sectional view taken along lines 35—35 of FIG. 16.
Figure 34:
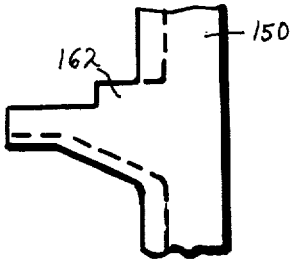
FIG. 34 is an enlarged cross sectional view partially in section taken along lines 34—34 of FIG. 16.
Figure 36:
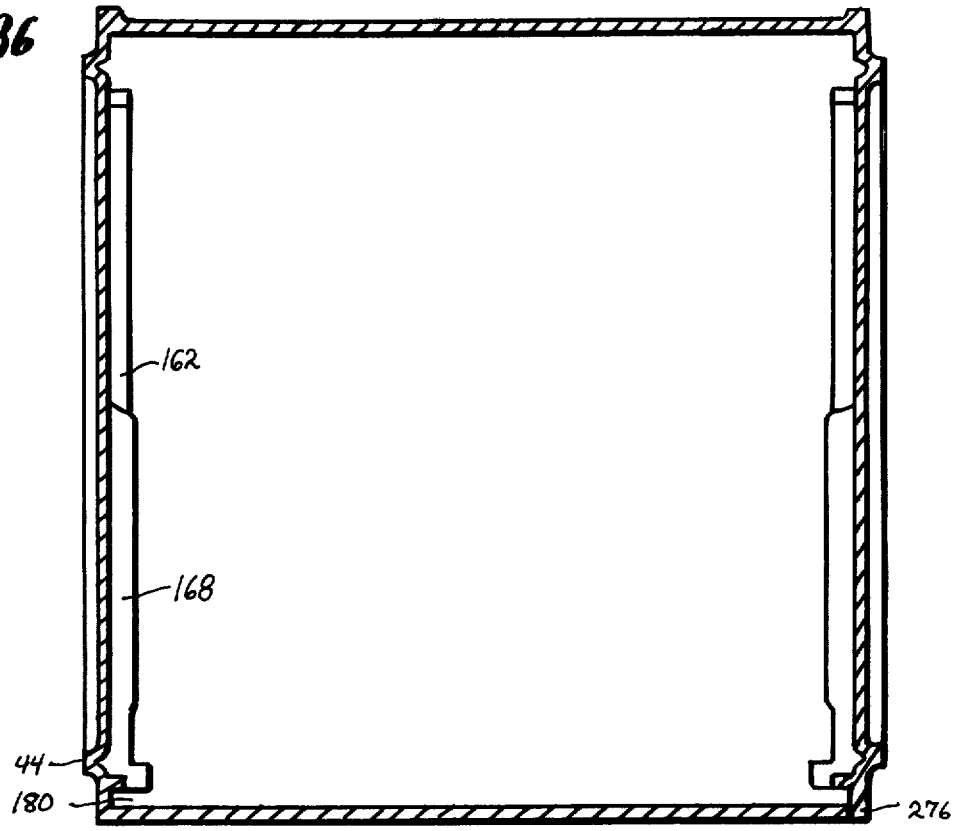
FIG. 36 is a cross sectional view taken along lines 36—36 of FIG. 16.
Figure 37:
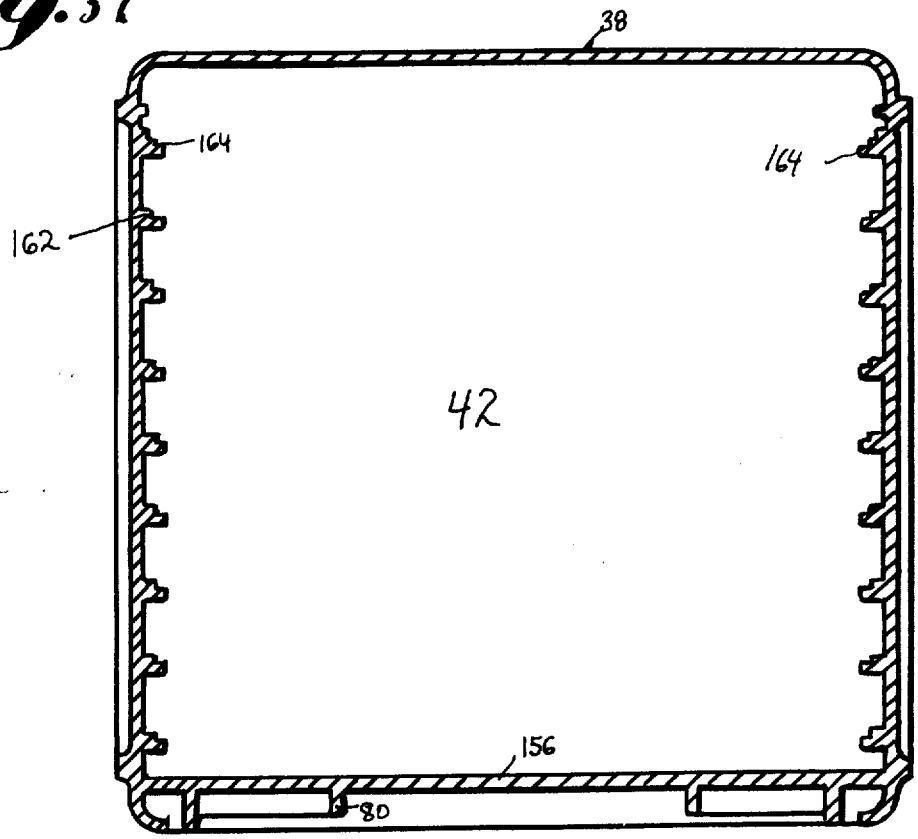
FIG. 37 is a cross sectional view taken along lines 37—37 of FIG. 16.

The wall rail 54 is basically comprised of a wall bracket 90 and a cover piece 100. The wall bracket 90 is first secured to the hospital's room's wall by means of suitable fasteners. The wall bracket is secured to the wall at an appropriate height so that the lower edge of the bracket is parallel to the floor of the room. The wall bracket 90 is composed of a strong metal (e.g. aluminum or steel). As shown best in FIG. 12, the wall bracket 90 has two wall-engaging flat surface 92 and 94. At suitable points along these flat surfaces, fasteners are drilled through the wall bracket and secured to the wall. At the top of the flat surface 92, the wall bracket forms a top piece 96 which extends substantially away from the wall of the room. A catch 98 is provided at the rearmost portion of the top piece 96. This catch 98 serves to keep the wall bracket cover piece 100 from being pulled away from the wall bracket 90. At the lower portion of flat piece 92 the wall bracket turns away from the wall to form wall bracket gripping leg 102. Flat piece 94 has at its lower end a perpendicular ledge 110 which terminates in an upwardly inclined segment 112, inclined away from the wall. The perpendicular ledge 110, flat piece 94, and inclined segment 112 form a "U" shape, hereinafter referred to as channel 72 of the wall rail. At the outermost edge of the perpendicular piece 110 is a lip 114. The lowermost portion of flat piece 94 has an incline 116 which extends upwardly and away from the wall bracket.

A hard plastic wall bracket cover 100 fits over the wall bracket 90 and is held securely in place at a plurality of points. The wall cover catch 118 fits over wall bracket catch 98. The top piece 120 of the wall cover, in addition to having the wall cover catch 118, is provided with a vertical flat portion 124. The vertical flat portion 124 ends with a gripping leg 126. This gripping leg 126 matingly engages and holds the gripping leg 102 of the wall bracket 90. When the wall bracket cover 100 is placed on the wall bracket 90 a cavity 128 is formed between the flat piece 92 and flat piece 124 of the wall bracket cover. The cavity 128 is functional in that it allows electrical wires, rubber tubing or any conduits to be passed around the room while prohibiting these conduits from being unnecessarily contaminated. Loose and open wires always have a hazardous potential and the fact that the conduits may be safely carried around the room without being open to the atmosphere is extremely beneficial. Additionally, the cavity 128 hides from vision the unsightly wires that tend to give a person or patient the feeling of lack of order or organization. As previously mentioned, the patient's morale in a hospital is often an important determining factor in the patient's physical health. From the base of the gripping leg 126 of the wall bracket cover to the ledge 76 of the inclined segment 112 the wall bracket cover follows the curvature of the wall bracket. The "U" channel 72 is thus formed, into which the wall rail engaging leg 64 of mounting key 52 is inserted for mounting the modular cell unit to the wall.

From the ledge 76 of inclined segment 112 to lip 114 of the wall bracket, the wall bracket cover extends vertically by planar face 132. A positioning leg 134 of the wall bracket cover 100 rests above the lip 114 of the wall bracket and serves to space planar surface 132 away from the inclined segment 112. The planar surface 132 ends in an inclined surface 136. The inclined surface 136 has a longitudinal finger 138 which is positioned above the incline 116 of the wall bracket. An undercut 140 matingly engages with the base portion of incline 116.

It can thus be seen that the wall bracket 90 is first secured to the wall of a room. Subsequently the wall bracket cover 100 is snapped over the wall bracket and held in place at a plurality of points. The wall bracket-wall bracket cover contact points are the catch 98 and top piece 120, top piece 96 and longitudinal rib 122, gripping leg 102 and gripping leg 126, ledge 76 and wall cover horizontal surface 121, lip 114 and positioning leg 134, incline 116 and finger 138, and undercut 140 and the base of the wall bracket in the area where the channel 72 is formed in the wall rail. An end cap 101 is also provided which serves to close off the edges or corners of the wall rails. If desired the end cap is provided with a punchout area so as to allow any conduits traveling in cavity 128 to enter and exit the wall rail.

The bottom 40 of the modular cell unit is comprised of a plurality of crisscrossing structural ribs 80. The structural ribs 80 define four pockets 82 at the corners of the bottom face 40. The pockets 82 are designed so as to frictionally receive a wheel base 84 which has a caster wheel 86 attached thereto. In this manner, when all four wheel bases 84 are placed within the wheel pockets 82, the modular cell unit can be moved about by merely rolling it on the floor. When the unit is moved to the desired location, the unit is secured to a wall rail as previously discussed and the wheel bases with their attached caster wheels removed.

Alternatively, a base 81, can be snapped beneath the bottom of the modular cell. The base would be provided with four side walls 83, 85, 87 and 89 generally coplanar with the vertical walls of the modular cells. The side walls of the base are constructed with small cutout sections 79, which sections straddle the ribs 80 of the bottom of the modular cell. In a preferred embodiment, the base 81 is itself provided with four wheels, one at each corner, so that the base can be snapped onto the modular cell and act as a dolly. This clearly facilitates mobility of the modular cell unit.

The internal cavity 43 of the modular cell unit 30 is comprised of side walls 150, rear wall 152, ceiling 154, and floor 156. The side walls 150 are mirror images of each other and thereby preserve the aesthetic and functional symmetry of the entire system. The ceiling 154 is provided with crisscrossing structural ribs 158 which enhance the unit's structural or load bearing capacity. The structural ribs run parallel and perpendicular to the top edges of the side walls 150. The floor 156 is smooth and flat so as to allow a tray or drawer, located with its bottom on the floor, to be withdrawn and stored easily, i.e., by merely sliding the drawer or tray along the floor. The rear wall 152, as best seen in FIG. 16, clearly evidences the rear surfaces and protrusions of the top longitudinal slots 48 and the lower leveling slot 50.

The side walls 150, as best shown in FIG. 17, have drawer glides 160, rear abutment stops 166, and drawer stop members 164 integrally molded thereon. The drawer glides, rear abutment stops and drawer stop members all extend interiorly from the side wall. The drawer glides 160 are parallel to each other and are also parallel to the floor 156 of the cavity 43 of the modular cell unit. The drawer glides 160 are comprised of a drawer support arm 162 which extends from the stop members 164 towards the rear wall 152. The drawer support arms 162 extend a substantial part, not less than one-half the length of the side walls 150. A rear abutment stop 166 is provided at the rearward end of the drawer support arms. The rear abutment stops 166 prevent a tray or drawer from being pushed into the cavity 43 of the modular cell a greater distance than the length of the trays or drawers. In this manner, the front walls of the drawers or trays will be aligned in a visually pleasing manner.

The top surface of the drawer support arms 162 provide the sliding surfce for the drawers or trays. The drawers or pull trays, or shelves, as will be later described, have gliders 200 which rest upon and slide over the drawer support arms 162.

The other leg of the drawer glides 160 form the horizontal stability arms 168. The horizontal stability arms 168 also extend inwardly from the side walls 150 of the cavity 43. The horizontal stability arms 168 are located above their corresponding drawer support arms 162. The horizontal stability arms extend, however, by means of incline surface 170 from the drawer support arm located immediately above. The drawer pull tray or shelves with its drawer glides 200 resting on the drawer support arms 162 have their top surfaces 202 sliding beneath the horizontal stability arms 168. When the drawers, shelves or pull trays have been withdrawn a significant distance the horizontal stability arms 168 prevent the forward edge of the drawers or trays from leaning downwardly and possibly falling out of the cavity 43 of the modular cell unit.

At the forward end of each drawer support arm 162 is a stop member 164. The stop member 164 has a curved upper surafce 165 which surface begins at a point where the upper edge of the drawer support arm 162 leaves off. The stop members 164 extend inwardly from the side walls 150 beyond the width of the drawer support arms. In the preferred embodiment the stop members 164 extend approximately one-half inch in distance past the width of the drawer support arm. The rear planar surface 172 of the stop member 164, also extends inwardly from the side walls 150. In the preferred embodiment this extension is also approximately one-half inch.

The rear planar surface 172 of the stop member 164 serves to prevent a drawer, shelf, or tray from being inadvertently totally withdrawn from the cavity 43 of the cell unit. When a drawer, shelf, or tray is withdrawn from the modular cell unit 30, the drawer stop 204, located beneath the drawer glide flanges 200, will engage and abut against the rear planar surface 172 of the stop member 164. This therefore prevents inadvertant withdrawal of the shelf, pull tray or drawer. If the user of the system desires to totally withdraw the shelf, pull tray, or drawer then the user merely manually tilts the forward end of the drawer, shelf or pull trays upwardly until the drawer top surface 202 is flush against the incline 170. The drawer, shelf or pull tray can now be withdrawn as the drawer stop 204 will not abut the rear planar surface 172 of the stop members 164.

The drawers, shelves or pull trays 272, 260 and 270, respectively, are provided with corner cut-outs 290. The corner cut-outs 290 are located at the rear of the drawer guides 200. When a drawer, shelf or pull tray is pushed into the modular cell unit, the rear abutment stops 166 contact the vertical planar edge 292 of the corner cut outs and thereby prevent the drawers, shelves or pull trays from being pushed further back into the cavity 43 than is desired.

The drawers and pull trays are provided with a plurality of drainage holes 267 which are located within the top surface 202 of the drawer or pull tray. The drainage holes serve to allow water to easily drain off after sterilization and thereby prevent water retention in the system. The elimination of water retention prolongs the useful life of the system in addition to the cutting down on the transfer of germs.

A trackway 180 is provided on both side walls 150. The trackway travels vertically in a parallel manner along the forward edge of the side walls 150. The trackway extends into a trackway hump portion 182 at the point where the trackway reaches the level of the uppermost drawer support arm 162. The trackway hump portion 182 connects the vertical portion of the trackway with the horizontal portion 184 of the trackway. The horizontal portion of the rackway travels in a path parallel to the ceiling 154 of the cavity unitl it reaches the rearward curved incline 302 of the trackway hump 182. It can thus be seen that the apex of the trackway hump is greater in relative height with respect to the floor 156 than the horizontal trackway 184. A trackway stop 186 is provided at the rear of the horizontal trackway 184.

In operation, a roll-top front 220, i.e., a flexible sliding top made of parallel slats, is held between the trackways 180 of the side walls 150. The length of the roll-top front 220 is sufficient to completely cover the front opening of the cavity 43 when the roll-top front is in its down or closed position. When access is desired into the modular cell cavity 43 the roll-top front can easily slide upwardly within the trackways into its storage position, i.e., resting in the horizontal portion 184 of the trackway. The trackway stop 186 prevents the roll-top front from falling out the back of the trackway. When the roll-top front is in its retracted or storage position, the roll-top front 220 is substantially held within the horizontal trackway portion 184. The length of the roll-top front 220 is, however, of sufficient magnitude that the leading edge of the roll-top front will lie forward of the apex of the trackway hump 182 at all times, even when the trailing edge of the roll-top front abuts the trackway stop 186. The trackway hump 182 serves to keep the roll-top front in its storage or retracted position until the user pulls the rolltop front downwardly to its operative position. A rolltop front handle 222 is also provided at the leading outside surface of the roll-top front in order to facilitate movement of the front.

In an alternate embodiment, a hinged door 230 is provided in lieu of the roll-top front 220. The hinged door 230 is secured to the cell by two ordinary hinge pieces. One leaf of the hinges is held by means of fasteners, e.g., screws or rivets in the vertical portion of the trackway 180. The other leaf of the hinge is held fixedly in place by means of suitable fasteners in a slot located in the side of the hinge door. A handle 239 is provided for the hinged door 230 at either the lower edge of the door, the upper edge or the outside edge of the door opposite to the location of the slots and hinges.

In yet another alternate embodiment, a sliding door 240 is provided to close the cavity 43 of the modular cell unit 30 from outside contamination, The sliding door 240, when in its inoperative or open position is held within the modular cell unit and out of sight. The sliding door 240 has a handle 242 at the lower leading edge of the door 240. The handle quite obviously facilitates the movement of the sliding door into an operative, i.e., closed position or into an inoperative or open position, On the underside of the handle 242 of the sliding door 240 are located two curved stop member surfaces 254. These surfaces extend perpendicularly to the plane of the sliding door and their function will be more fully explained hereinafter. Brackets 244 are provided on the side edges of the door at a point proximate to the top or trailing edge 246. The brackets 244 are comprised of an outwardly extending ear portion 248 which serves as a base for sliding pins 250. A curved wall 252 extends perpendicularly to the ear 248 of the bracket 244. The function of the curved wall will also be more fully explained hereinafter. An extension of the curved wall 252, also perpendicular to the ear portion 248, is the glide wall 256.

In operation, when the sliding door 240 is in its retracted position, the glide walls 256 rest upon the top set of drawer glides 160 located along the side walls. The sliding pins 250 are located beneath the drawer glides 160. When it is desired to close the unitary modular cell, the handle 242 is grasped and the sliding door 240 is moved forwardly with the glide walls 256 of the brackets 244 resting upon and gliding over the drawer glides 160. When the length of the sliding door 240 is totally withdrawn from the modular cell and held in a horizontal orientation, the sliding pins 250 will but against the rear vertical surfce 255 of stop member 264. In this manner, the sliding door 240 cannot be accidentally withdrawn from the modular cell unit. The sliding pins 250, when held against the rear vertical surface 255 of the stop members provide a hinging and pivot point for the sliding door so that it can drop vertically into place, thereby closing off the cavity 43 of the modular cell unit. The curved wall 252 of the brackets 244 glides over the curved surface 165 of the stop members 264. The stop member surfaces 254, located on the rear surface of sliding door, holds the sliding door 240 in position by surfaces 254 being held beneath the curved surfaces 165 of the lowermost set of stop members 164 located at the bottom of the cavity 43. In order to open the modular cell unit, the handle 242 of the sliding door is grasped and the sliding door is pivoted about sliding pins 250 until the sliding door is in a horizontal position. When the sliding door is in its horizontal position, the handle can be pushed rearwardly, such that the sliding door glides along the drawer glides 160 until the door is totally contained within the modular cell unit.

When the sliding door is in its retracted position, the door is prevented from being pushed too far back into the cavity of the modular cell unit by the abutment of stop member surfaces 254 against the curved surfaces 165 of the stop members 164 of the corresponding drawer glide 160 upon which the sliding door travels.

When it is desired to sanitize the modular cell unit and its accompanying sliding door, the sliding door 240 can be totally withdrawn from the modular cell unit by pulling the sliding door into its horizontal withdrawn position, and then lifting the sliding pins 250 above the curved surfaces 165 of the stop members 164.

In addition to the storage of drawers, the modular cell unit can be utilized to store planar shelves 260 which also slide into and out of the cavity 43 in a manner similar to the drawers previously discussed. As best seen in FIG. 22*a*, a shelf tray 260 has a top planar surface 264, which is useful in supporting a plurality of assorted items in the modular cell unit. Shelf glides 262 are provided on both sides of the top planar surface 264. The shelf glides 262 slide upon the drawer glides 160. Beneath the shelf glides 262 are located shelf stop members 266. In order to prevent the shelves from being unintentionally withdrawn from the modular cell unit, the shelf stop members 266 are provided, which stop members abut the rear planar surfaces 172 of the stop members 164. In a manner qite similar to the withdrawal of the pull trays or drawers, the shelves 260 may be withdrawn from the modular cell unit by lifting the shelf stop members 266 above the stop members 164. The height of the shelf glides 262 is such that they fit within the space between the drawer support arm 162 and the horizontal stability arms 168.

It will now be appreciated that the modular cell unit can be provided with pull rays 270, planar shelves 260 or drawers 272. If the pull trays or shelves are employed then any of the previously described front closures may be employed. The choice of which front is to be used is totally left up to the user. However, it should be noted that the drawers 272 are made by attaching a drawer handle 274 to the front of a pull tray 270. If drawers are used to fill the cavity 43 of the modular cell unit then the various fronts are no longer necessary. The drawer handles 274 will be flush with the front rim 276 of the modular cell unit when placed in their closed positions.

The pull tray 270 can be provided with a handle 274. The handle comprises a rear flat piece 278 which is co-planar with the front 280 of the pull tray. An inclined surface 282 extends downwardly from the flat piece 278 and serves to provide a gripping area for an operator's hand in order to facilitate easy withdrawal of the drawer. On both sides of the rear of the handle are guide slots 284. The guide slots form "U" shaped channels which slide over and matingly engage the sides 288 of the front 280 of the pull tray. The guide slots 284 or channels are open on the top of the handle and closed towards the bottom of the handle. The front 280 of the pull drawer is provided with a retainer lip 286. The retainer lip extends perpendicularly to the front side of the pull drawer.

In operation, in order to convert a pull tray to a drawer, the handle 274 is directed such that the sides 288 of the front 280 of the pull drawer pass within the channel formed by the guiding slots 284. This is accomplished by sliding the open ends of the guide slots 284 upwardly over the sides 288 of the front. The rear planar surface of the handle will pass over the retainer lip 286. As the guide slots 284 are closed at their lower ends, the handle cannot continue to slide across the front of the drawer. When the lower edge of the handle passes over the retainer lip 286 the handle is effectively locked in place. The handle cannot slide off downwardly because the retainer lip prevents the handle's downward motion. The handle cannot slide off the front upwardly because the closed ends of the guide slots prevent such movement. Thus it can be seen that the handle can securely attach to the front of a pull tray and convert the same to a drawer. If the drawer is to be reconverted to a pull tray the user can merely push the retainer lip in a direction towards the rear of the drawer while at the same time sliding the rear surface of the handle over the retainer lip in a downward direction.

While the preferred embodiment of the invention has been disclosed, it is understood that the invention is not limited to such an embodiment since may be otherwise embodied in the scope of the appended claims.

What is claimed is:

1. A storage unit comprising two side walls, a rear wall, a top wall and a bottom wall, a frontal opening to a storage cavity defined by the internal surfaces of said walls, said storage cavity adapted to selectively receive support means adapted to support a plurality of items to be stored, said support means defining glide surfaces and being selectively slidable into and out of said storage cavity by sliding upon support means glide surfaces, said glide surfaces sliding between associated pairs of support arms and stabilizing arms extending from said side walls, said arms being integrally molded with the internal surface of said side walls and extending inward from said side walls, said stabilizing arms preventing removal of said support means from said storage cavity when said support means is partially withdrawn from said storage cavity, a drop front door with a handle mounted to said unit, said drop front door being provided with ear portions, said ear potions extending perpendicularly to said drop-front door and located towards the rear and side of said door, each of said ear portions having a pin extending therefrom, siding surface means also extending from said ear portions, said sliding surfaces sliding on top of said support arms, said pins sliding beneath said support arms when said door is moved into its operative or inoperative position, said pin means hinging at a rear planar surface of abutment stops, said abutment stops extending away from said internal surfaces of said side walls and integrally molded thereon, said ear portions of said drop-front door also being provided with a curved surface, said curved surface gliding over the top surface of said abutment stops when said drop-front door is hinged into its operative position.

2. A storage unit as claimed in claim 1 wherein the stabilizing arms extend horizontally along the side walls more than one-half the depth of said storage cavity.

3. A storage unit as claimed in claim 1 wherein each stabilizing arm is connected to the support arm immediately above it by an inclined surface, said inclined surface extending from the forwardmost portion of said stabilizing arm to the forwardmost portion of said support arm.

4. A storage unit as claimed in claim 1 wherein the support arms are provided with stop means at their rearmost portion, said stop means being configured so as to engage and abut against corresponding vertical planar surfaces located proximate to the glide surfaces of said support means, limiting the slide of said support means into said storage cavity.

5. A storage unit as claimed in claim 4 wherein said vertical planar surfaces define cut-out portions located at the rear corners of said support means.

6. A storage unit as claimed in claim 1 wherein said abutment stops are integrally molded with the forwardmost portion of said support arms, said abutment stops extending away from said internal surfaces of said side walls to provide a rear planar surface which coacts and abuts stop means located beneath glide surfaces of said support means to prevent the accidental withdrawal of said support means.

7. A storage unit as claimed in claim 1 constructed of a heat resistent, durable plastic.

8. A storage unit as claimed in claim 1 wherein the bottom wall of said unit is provided with a plurality of structural ridges.

9. A storage unit as claimed in claim 8 wherein the structure ridges define a plurality of pockets which frictionally receive and secure correspondingly shaped bases of caster-wheel assemblies, said unit being transportable upon said wheel assemblies.

10. A storage unit as claimed in claim 8 wherein the structural ridges are adapted to receive corresponding cut-outs located in side walls of a base.

11. A storage unit as claimed in claim 1 including a base unit comprised of four side walls, said side walls defining cut-out portions, which cut-out portions coact and frictionally engage structural ridges located in the bottom wall of said storage unit.

12. A storage unit as claimed in claim 11 wherein the plurality of wheels are mounted to said base.

13. A storage unit as claimed in claim 1 wherein a tambour door is mounted to said unit.

14. A storage unit as claimed in claim 1 wherein the support means is a drawer, tray, or shelf.

15. A storage unit comprising a top wall, bottom wall, rear wall and side walls defining a cavity comprising at least one pair of support arms directly opposing one another and extending internally from the side walls of said storage cavity, a receptacle means defining a second stop means, at least one pair of stability arms also extending internally from the side walls defining said cavity, said stability arms extending substantially parallel to said support arms and spaced therefrom so as to define a channel there between which allows said receptable means to slide into or out of said storage unit, said stability arms being connected to said support arms by an inclined arm, said inclined arm extending inwardly from said side walls, and located proximate to the opening of each cavity, stop means located at the forward portion of each of said support arm, said stop means providing abutment surfaces which abut second stop means located on said receptacle means to preclude unintentional withdrawal of said receptacle means, said inclined arms being constructed to allow said second stop means of said receptacle means to bypass said stop means when said receptacle means is lifted.

16. A storage unit as claimed in claim 15 wherein the receptacle means is a drawer.

17. A storage unit as claimed in claim 15 wherein the receptacle means is a tray.

18. A storage unit as claimed in claim 15 wherein the receptacle means is a shelf.

19. A storage unit as claimed in claim 15 which is constructed of heat-resistant, durable plastic.

20. A storage unit comprising a top wall, bottom wall, rear wall and side walls defining a cavity comprising at least one pair of support arms directly opposing one another and extending internally from the side walls of said storage cavity, a receptacle means defining a second stop means, at least one pair of stability arms also extending internally from the side walls defining said cavity, said stability arms extending substantially parallel to said support arms and spaced therefrom so as to define a channel there between which allows said receptacle means to slide into or out of said storage unit, stop means located at the forward portion of each of said support arms, said stop means providing abutment surfaces which abut second stop means located on said receptacle means to preclude unintentional withdrawal of said receptacle means, said support arms also being provided with rearward stop means, said rearward stop means limiting the depth of said receptacle means sliding into said cavity.

21. A storage unit as claimed in claim 20 wherein said rearward stop means comprises a vertical planar surface which abuts against a second vertical planar surface defined by said receptacle means, said second vertical planar surface comprising corner cut-outs of said receptacle means.

22. A storage unit comprising a top wall, bottom wall, rear wall and side walls defining a cavity comprising at least one pair of support arms directly opposing one another and extending internally from the side walls of said storage cavity, a receptacle means defining a second stop means, at least one pair of stability arms also extending internally from the side walls defining said cavity, said stability arms extending substantially parallel to said support arms and spaced therefrom so as to define a channel there between which allows said receptacle means to slide into or out of said storage unit, stop means located at the forward portion of each of said support arms, said stop means providing abutment surfaces which abut second stop means located on said receptacle means to preclude unintentional withdrawal of said receptable means, said abutment surface of said stop means comprising a vertical planar surface and said second stop means of said receptacle means comprising tab means defining a vertical planar surface located proximate to the sides of the receptacle means.

23. A storage unit comprising a top wall, bottom wall, rear wall and side walls defining a cavity comprising at least one pair of support arms directly opposing one another and extending internally from the side walls of said storage cavity, a receptacle means defining a second stop means, at least one pair of stability arms also extending internally from the side walls defining said cavity, said side walls of said cavity defining a trackway adapted to receive and allow selective movement of a tambour door, said trackway extending along the opening and ceiling of said cavity, said stability arms extending substantially parallel to said support arms and spaced therefrom so as to define a channel there between which allows said receptacle means to slide into or out of said storage unit, stop means located at the forward portion of each of said support arms, said stop means providing abutment surfaces which abut second stop means located on said receptacle means to preclude unintentional withdrawal of said receptacle means.

24. A storage unit as claimed in claim 23 wherein the tambour door is prevented from accidental withdrawal by a rear tambour door stop means located at the rear of the trackway.

25. A storage unit as claimed in claim 23 wherein the trackway includes a hump located proximate to the top of the opening of said cavity, said hump portion allowing the leading edge of said tambour door to be grasped while simultaneously keeping said tambour door in an inoperative, stored condition in that portion of said trackway which extends parallel to the ceiling of said storage unit.

26. A storage unit comprising a top wall, bottom wall, rear wall and side walls defining a cavity comprising at least one pair of support arms directly opposing one another and extending internally from the side walls of said storage cavity, a receptacle means defining a second stop means, at least one pair of stability arms also extending internally from the side walls defining said cavity, said stability arms extending substantially parallel to said support arms and spaced therefrom so as to define a channel there between which allows said receptacle means to slide into or out of said storage unit, stop means located at the forward portion of each of said support arms, said stop means providing abutment surfaces which abut second stop means located on saic receptacle means to preclude unintentional withdrawal of said receptacle means, and a drop-front door mounted in said unit and stored in inoperative position supported by a top pair of support arms.

* * * * *